US008782863B2

(12) United States Patent
Pfeiffer

(10) Patent No.: US 8,782,863 B2
(45) Date of Patent: Jul. 22, 2014

(54) PRESS TOOL FOR CONNECTING IN PARTICULAR TUBULAR WORKPIECES

(75) Inventor: Heinrich Pfeiffer, Kaarst (DE)

(73) Assignee: Novopress GmbH Pressen Und Presswerkzeuge & Co. KG, Neuss (DE)

( * ) Notice: Subject to any disclaimer, the term of this patent is extended or adjusted under 35 U.S.C. 154(b) by 241 days.

(21) Appl. No.: 13/383,349

(22) PCT Filed: Jul. 2, 2010

(86) PCT No.: PCT/EP2010/059461
§ 371 (c)(1),
(2), (4) Date: Jan. 10, 2012

(87) PCT Pub. No.: WO2011/006778
PCT Pub. Date: Jan. 20, 2011

(65) Prior Publication Data

US 2013/0025101 A1 Jan. 31, 2013

(30) Foreign Application Priority Data

Jul. 15, 2009 (DE) ..... 20 2009 009 456 U

(51) Int. Cl.
*B25B 27/10* (2006.01)

(52) U.S. Cl.
USPC ..... 29/237; 29/272; 29/282; 29/283.5; 269/43

(58) Field of Classification Search
CPC ..... B25B 27/10; B21D 39/04
USPC ..... 29/237, 272, 282, 283.5, 235; 269/43, 269/130–132; 228/49.3, 44.5
See application file for complete search history.

(56) References Cited

U.S. PATENT DOCUMENTS

| | | | | | |
|---|---|---|---|---|---|
| 1,818,435 | A | | 8/1931 | Smith et al. | |
| 2,704,061 | A | * | 3/1955 | Amspacker | 606/140 |
| 2,980,928 | A | * | 4/1961 | Wallace et al. | 470/58 |
| 3,281,927 | A | * | 11/1966 | Buslaff | 29/235 |
| 3,662,450 | A | | 5/1972 | Kish et al. | |
| 4,520,542 | A | * | 6/1985 | Villanyi | 29/224 |
| 4,666,138 | A | * | 5/1987 | Dearman | 269/43 |
| 4,726,575 | A | * | 2/1988 | Dearman | 269/43 |
| 4,934,673 | A | * | 6/1990 | Bahler | 269/43 |
| 5,148,698 | A | | 9/1992 | Dischler | |
| 5,209,100 | A | * | 5/1993 | Dischler | 72/409.01 |

(Continued)

FOREIGN PATENT DOCUMENTS

| | | |
|---|---|---|
| DE | 102009032113 | 1/2011 |
| EP | 0627273 | 12/1994 |

OTHER PUBLICATIONS

International Search Report for PCT/EP2010/059461 dated Nov. 5, 2010.

*Primary Examiner* — George Nguyen
(74) *Attorney, Agent, or Firm* — Ohlandt, Greeley, Ruggiero & Perle, LLP

(57) ABSTRACT

A press tool, such as a press sling for pressing in particular tubular workpieces, comprises a plurality of articulated press elements connected to one another in the form of a chain. The press tool is open between two end press elements for forming a closing site between two end press elements. In order to unlatch the press tool from a closed position in which the closing site is substantially closed, a handling element is provided according to the disclosure. Said tool alternatively also serves for releasing a press jaw mounted on a press jaw carrier.

17 Claims, 4 Drawing Sheets

(56) References Cited

U.S. PATENT DOCUMENTS

| | | | | |
|---|---|---|---|---|
| 5,666,711 | A | 9/1997 | Pfeiffer | |
| 5,697,135 | A * | 12/1997 | Dischler | 29/237 |
| 5,865,430 | A * | 2/1999 | Conover et al. | 269/43 |
| 5,890,270 | A * | 4/1999 | Oetiker | 29/235 |
| 6,405,411 | B1 | 6/2002 | Allemann et al. | |
| 6,840,433 | B2 * | 1/2005 | Vermaat | 228/212 |
| 7,143,626 | B2 * | 12/2006 | Dole | 72/416 |
| 7,779,523 | B2 * | 8/2010 | Frenken | 29/237 |
| 7,788,779 | B2 * | 9/2010 | Frenken | 29/237 |
| 8,082,645 | B2 * | 12/2011 | Levins et al. | 29/235 |
| 8,336,177 | B2 * | 12/2012 | Vernasca et al. | 29/237 |
| 8,448,320 | B2 * | 5/2013 | Yater et al. | 29/282 |
| 8,490,261 | B2 * | 7/2013 | Frenken et al. | 29/237 |
| 2010/0229368 | A1 * | 9/2010 | Frenken et al. | 29/516 |
| 2011/0023278 | A1 * | 2/2011 | Oba et al. | 29/235 |
| 2013/0025101 | A1 * | 1/2013 | Pfeiffer | 29/237 |

* cited by examiner

PRESS TOOL FOR CONNECTING IN PARTICULAR TUBULAR WORKPIECES

BACKGROUND

1. Field of the Disclosure

The disclosure relates to a press tool for connecting in particular tubular workpieces, the connecting process being performed particularly by pressing.

2. Discussion of the Background Art

Especially for establishing connections between tubes, it is known to use sleeve-shaped press fittings. These are shifted over the two tube ends which are to be connected and are plastically deformed by means of a press tool. The press fittings are normally made of metal. The inner diameter of the press fitting is selected to be slightly larger than the outer diameter of to-be-connected the tube ends so that, under the effect of the radial pressing action, the inner side of the press fitting will be pressed onto the outer side of the tube ends and, due to the permanent deformation, there will be produced a tight and, particularly, sealed connection.

For establishing the connection, particularly the press-connection, press tools and resp. press rings are known. From EP 06 27 273, a multi-component press ring is known. This press ring comprises a plurality of press elements articulated to each other in the form of a chain. Said press elements will be laid around the tubular workpieces, i.e. onto the press fitting mounted on the tube ends. On the open end of the press tool, i.e. at the closing site of the press tool, a drive device can be applied. With the aid of the drive device, full closure of the press tool is effected in that the two end press elements, i.e. the two press elements having the closing site arranged between them, are moved toward each other. Via suitable connection elements such as e.g. pins, the drive element can be connected to the two end press elements for closing the press tool.

From EP 06 27 273, it is known that a least a part of the press elements comprises a press jaw carrier holding one or a plurality of press jaws thereon in a displaceable manner. The press jaw carriers of the individual press elements are articulated to each other. Since the press jaws are held displaceably, it is possible to accomplish a satisfactory press-connecting process by use of such a press ring. Because of the displaceability of the press jaws on the press jaw carriers, the closing of the press tool can be performed by use of a corresponding drive means engaging only the end press elements. It is not required that each individual press jaw be moved radially inward for performing the pressing process. During the closing process and resp. press-connecting process, the press jaws are moved toward each other in the circumferential direction of the press fitting. Thus, between the press jaws, there first exists a gap which will be at least partially closed during the pressing process.

In order to keep the press tool from dropping down after completion of the pressing process, it is known to connect the two end press elements in this position. This can performed e.g. by levers or hooks. Such holding elements, however, have the disadvantage that, before removing the press tool, they have to be separately detached, thus involving an additional working step.

It is an object of the disclosure to provide a press tool such as e.g. a press ring for connecting in particular tubular workpieces, wherein the holding and/or the subsequent opening of the press tool in and resp. from a closed position is facilitated.

SUMMARY

The press tool of the disclosure, which particularly is a press ring, serves for connecting particularly tubular workpieces such as e.g. tube ends with the aid of a press fitting. The press fitting comprises a plurality of press elements which are articulated to each other. Thus, the press elements are configured in a chain-like manner and form an open press ring. The press tool is open in the region of the two end press elements, thus forming a closing site in this region. The closing is effected particularly in that an e.g. tongs-shaped drive element will be engaged on the two end press elements so that the two end press elements will be moved toward each other for closing the press ring. Thereby, the corresponding press connection is achieved. Prior to initiating the pressing process, the mutually opposite press elements will be laid around the workpieces which are to be press-connected to each other, notably in the manner of a press fitting. Thereafter, a particularly tongs-like drive device will be connected to the end press elements, and the pressing process will be carried out. In the closed position, the press tool is either held in position in an independent manner e.g. due to friction and the counterpressure between the press jaws and the press fitting, or a holding element is provided. In the disclosure, there is provided, according to a first preferred embodiment thereof, a handling element for unlatching the pressing tool from the closed position. By a corresponding handling element, for instance, the mutually abutting end press elements will be forced apart from each other. Thereby, opening the press ring is considerably facilitated. Further, it is possible to use the handling element for unlatching a holding element or an arresting means such as e.g. a locking element, by which the press tool is held in the closed position.

Particularly preferred is the provision of a handling element in connection with a press ring, wherein at least one and preferably both end press elements comprise a respective press jaw carrier and a respective press jaw, at least one of said press jaws being displaceably held on the press jaw carrier. Such a press tool is described particularly in EP 0 627 273 and in the present Applicant's German Patent Application filed on Jul. 7, 2009 under the title "Presswerkzeug sowie Verfahren zum Verpressen von ins-besondere rohrförmigen Werkstücken" (File No.: 10 2009 032 113.6). The disclosure particularly is an advanced development of such press tools.

Especially in said patent application filed by the Applicant on Jul. 7, 2009 (File No.: 10 2009 032 113.6), the provision of a handling element according to the disclosure is advantageous because it allows said at least one end press element to be released in a simple manner. By the provision of the handling element of the disclosure, the displaceable press jaw can be released from the closed position in a simple manner.

Preferably, the holding element comprising said at least one lever element is pivotably connected to a displaceable press jaw and, via a counterabutment, to the corresponding press jaw carrier. Of course, said pivotable connection can also be provided on the press jaw carrier while said counterabutment is correspondingly provided on the press jaw. By pivoting or rotating the lever element about the counterabutment, the press jaw will be displaced. Optionally, this will be accompanied by a displacement of the lever element in the counterabutment wherein, in such an embodiment, the counterabutment comprises a pin guided in a longitudinal hole. The longitudinal hole herein is preferably provided in the lever element but can also be provided in the press jaw carrier or in one of the press jaws themselves. The pin is correspondingly arranged on the respective other component part.

By pivoting said at least one and preferably both lever elements, the press tool can be unlatched. In this embodiment, it is possible e.g. that, at the end of the pressing process, the two end press elements will be transferred into a locked position via a holding element or the like. In this regard, it is possible e.g. that a locking element will be closed, particularly automatically. Thereby, it is guaranteed that, also after the pressing process, the press tool will be safely held for the time being. By actuating the handling element, particularly both lever elements, the press tool can then be unlatched by releasing the holding element, i.e. particularly by releasing the locking connection.

According to a further preferred embodiment of the disclosure, wherein at least one of the two end press elements comprises a press jaw carrier and a displaceable press jaw, the handling element serves for displacing or releasing of the at least one displaceable press jaw. In such a press tool, the press jaw of the end press element, when in its closed position, can slide e.g. into a recess. Avoided in this manner is a self-induced loosening or pivoting of the end press element, so that the press tool will be maintained in the closed position. For returning the press tool into the initial position, it is required this press tool will be pulled out of the recess again. According to the disclosure, this is performed by the handling element, particularly by a corresponding pivoting movement of the lever element.

Preferably, in this preferred embodiment, a guide element is provided which cooperates with the displaceable press jaw, wherein this guide element comprises said recess. In the closed position, the displaceable press jaw will slide into this recess and, with the aid of the handling element, will be pulled out again from the recess and returned to the initial position. Preferably, in this process, by pivoting the at least one lever element, the press jaw is resp. shifted relative to the recess. In this preferred embodiment of the end press elements in connection with a guide element, the guide element is configured in such a manner that, during the pressing process, the two press jaws of the two end press elements will initially moved toward each other in a first pressing stage.

In a particularly preferred embodiment of the disclosure, the at least one guide element and resp. both guide elements comprises/comprise a guide surface having an abutment element abutting thereon. By said guide surface, the movement of the corresponding press jaw during the first pressing stage or the whole pressing stage is well-defined. For this purpose, it is preferred that the guide surface is inclined in the direction of a gap. Thus, the guide surface does not extend radially relative to the workpiece to be pressed, but at least slightly in the direction of the closing site, i.e. in the direction of the gap between the two press jaws of the end press elements. Thereby, the movement—as provided by the disclosure—of the two press jaws of the end press elements toward each other is guaranteed.

The guide element can be designed e.g. in such a manner that the press jaw carrier of the end press elements is provided with a slot or a groove guiding therein a pin which is tightly connected to the corresponding press jaw. Of course, said pin can also be provided on the press jaw carrier, and the groove or slot can be provided in the corresponding press jaw.

According to a particularly preferred embodiment of the guide element, the guide surface is formed by the press element arranged adjacent to the respective end press element. In this arrangement, said adjacent press element comprises a guide cam or the like, particularly on the press jaw carrier. Preferably, in this embodiment, said abutment element is formed on the respective press jaw of the end press element. Thus, the abutment element and resp. a corresponding abutment surface of the press jaw, is in abutment on the guide surface of the adjacent press element, wherein, during the first pressing stage, the abutment element will slide along the preferably inclined guide surface.

Preferably, the guide element comprises a recess for allowing, in a second pressing stage which temporally follows the first press stage, a movement of the at least one press jaw of the end press element in the direction of the adjacent press element. In this regard, it is preferred that the abutment element will slide into the recess, with the recess preferably being formed on the adjacent press element. With preference, the recess is formed on the press jaw carrier of the adjacent press element, in as far as the adjacent press element is a press element comprising a press jaw carrier and a press jaw displaceably held by the press jaw carrier.

By the provision of such a recess and the resultant possibility of a movement of the press jaw of the end press element in the direction of the adjacent press jaw, the slot between the press jaw of the end press element and the adjacent press jaw will be closed or undergo a reduction of the slot width during the second press stage. Thus, according to the disclosure, there is first performed, in a first pressing stage, a closing or reduction of the gap at the closing site, i.e. of the gap between the two press jaws of the end press elements, and, subsequently, a closing or reduction of the gap between these press jaws and the respective adjacent press jaws of the adjacent press elements. Due to this defined movement of the press jaws, preferably those of both end press elements, the burr formation and the unroundness of the press connection can be distinctly reduced, and the quality of the press connection can thus be considerably improved.

Instead of using a recess, it can also be provided that the slot or groove is curved in a corresponding manner in the direction of the adjacent press element so that, because of the pins sliding in the slot and resp. the groove, a corresponding defined movement of the press jaw is guaranteed also in this case.

The press tool of the disclosure will be explained in greater detail hereunder by way of a preferred embodiment and with reference to the accompanying drawings.

DETAILED DESCRIPTION OF THE PREFERRED EMBODIMENT

Figure 2:
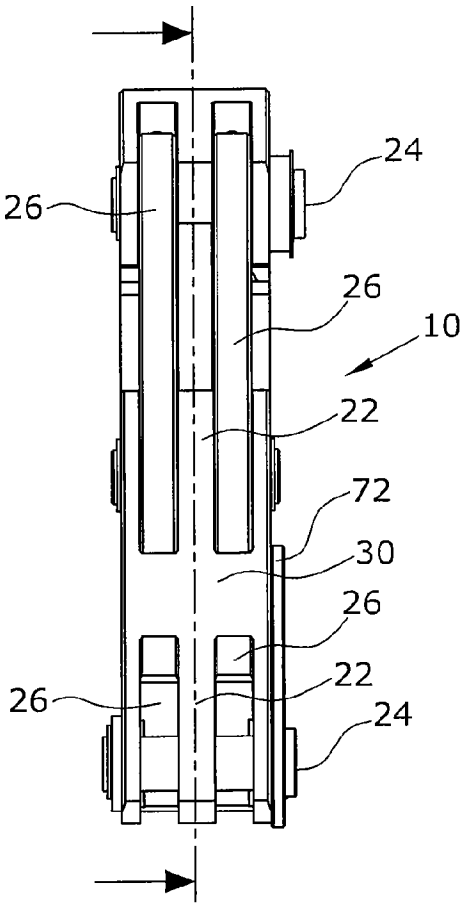
FIG. 2 a schematic lateral view of the press tool of the disclosure according to FIG. 1, FIG. 3 a schematic sectional view of the press tool in the opened position, FIG. 4 a corresponding sectional view of the press tool during the press connection process in the first pressing stage, FIG. 5 a corresponding sectional view of the press tool during the press connection process at the start of the second pressing stage, FIG. 6 a corresponding sectional view of the press tool at the time of completion of the press connection process, and FIG. 7 a schematic sectional view of the press tool, illustrating the opening process after completion of the press connection.

The press tool in its illustrated embodiment comprises five press elements 10, 12, 14, wherein the two press elements 12 and the two press elements 14 are arranged with mirror symmetry. The rigid press element 10 is of such a design that, at the inner side, it comprises a surface 18 shaped like the segment of a circle and forming a press jaw 16. A base body 20 of press element 10 is integrally connected to two projections 22. By means of pins 24, the two press elements 12 are pivotably connected to said projections 22 of press element 10. Said connection is realized respectively via a two-part press jaw carrier 26 (FIG. 2).

By means of further pins 28, the press elements 12 are connected, again in a pivotable manner, to press jaw carriers 30 of the end press element 14. The two end press elements 14 respectively form the end of the press elements connected in a chain-like manner, and they are not articulated to each other anymore, thus forming an opening 32 for allowing the press tool to be guided over the workpieces which are to be connected to each other.

The two press elements 12 which in the illustrated embodiment are arranged in the middle are designed to the effect that the press jaws 34 are displaceable in the circumferential direction.

In the illustrated embodiment, also the two end press elements 14 comprise two press jaws 38 which opposite to the respective press jaw carrier 30 are fastened in a displaceable manner, wherein, according to the disclosure, the displaceability of the press jaws 38 is not free but is defined.

The displacement of the press jaws 34 in the direction of arrow 36 will occur in dependence on the prevailing forces and frictions. Substantially, a pressing surface 40 of the two press jaws 34 is acted on by the frictional forces occurring between this surface and the surface of the fitting. Further, the press jaws 34 are acted on by spring forces because the press jaws 34 are normally not held in the press jaw carriers 26 in a freely displaceable manner but, instead, a bias is generated by springs. Except for this, however, the displacement of the press jaws 34 during the pressing process is not defined and will take place particularly in dependence on the occurring frictional conditions. After the press tool, while in its opened position (FIG. 3), has been mounted over the to-be-pressed workpieces, the workpiece will be closed into the position according to FIG. 4 in which the inner sides 18, 40, 42 of the press jaws 16, 34, 38 are in abutment on the outer side of the workpiece and of the press fitting. In this initial position, a drive tool by which the closing of the press tool and thus the press connection of the workpieces is performed, will be connected to pins 44. The pins 44 are tightly fastened to the press jaw carrier 30 of the two end press elements 14. Said drive means comprises e.g. two hook-shaped projections cooperating with pin 44 and moving the two projections toward each other for closing the press tool.

Figure 1:
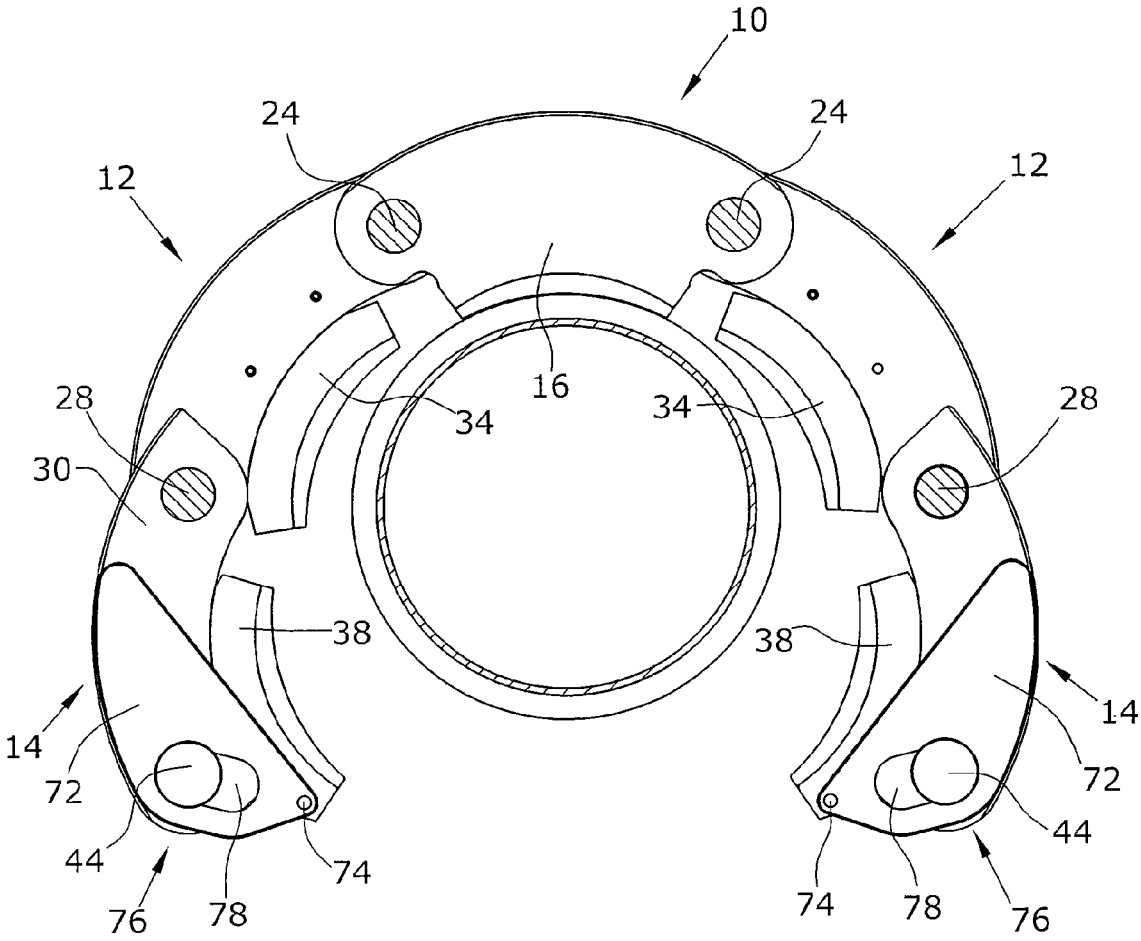
FIG. 1 a schematic plan view of the press tool of the disclosure.

The handling element according to the disclosure comprises, in the illustrated embodiment, two lever elements 72 arranged on an outer side of the end press elements 14 (FIG. 1). For illustrating the movement of the lever elements 72, these are partly represented in interrupted lines in FIGS. 3 to 7. The lever elements 72 are pivotable about a pin and resp. bearings 74. Each of bearings 74 is connected tightly to the press jaws 38. Further, each of the two lever elements 72 is connected to the respective press jaw carrier 30 via a counterabutment 76. In the illustrated embodiment, said counterabutment is formed by pin 44 which is also engaged by the drive means closing the press tool. The pivot or pin 44 of counterabutment 76 extends through a longitudinal hole 78 provided in lever element 72. The lever element 72 is thus held for displacement in the direction of longitudinal hole 78.

Figure 3:
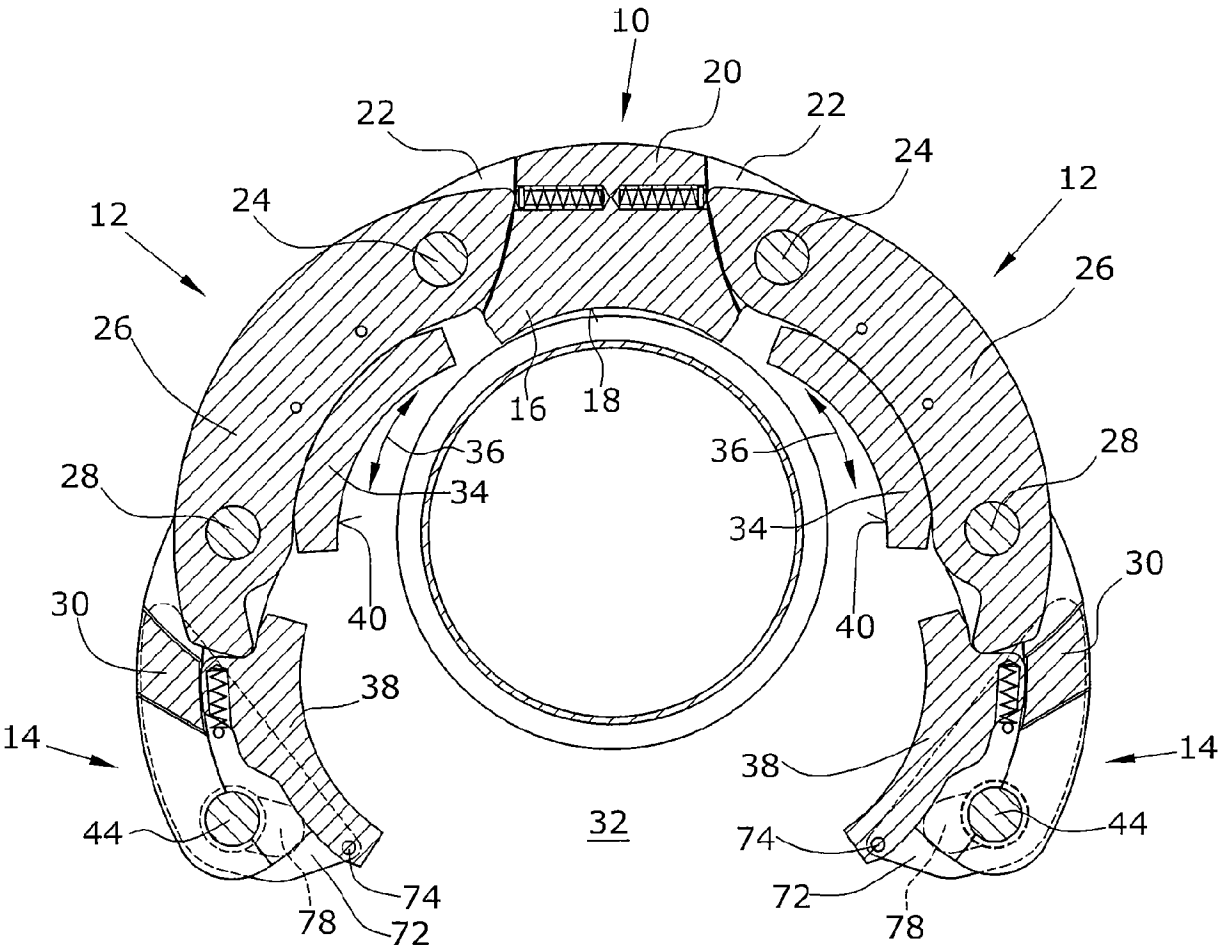
Figure 4:
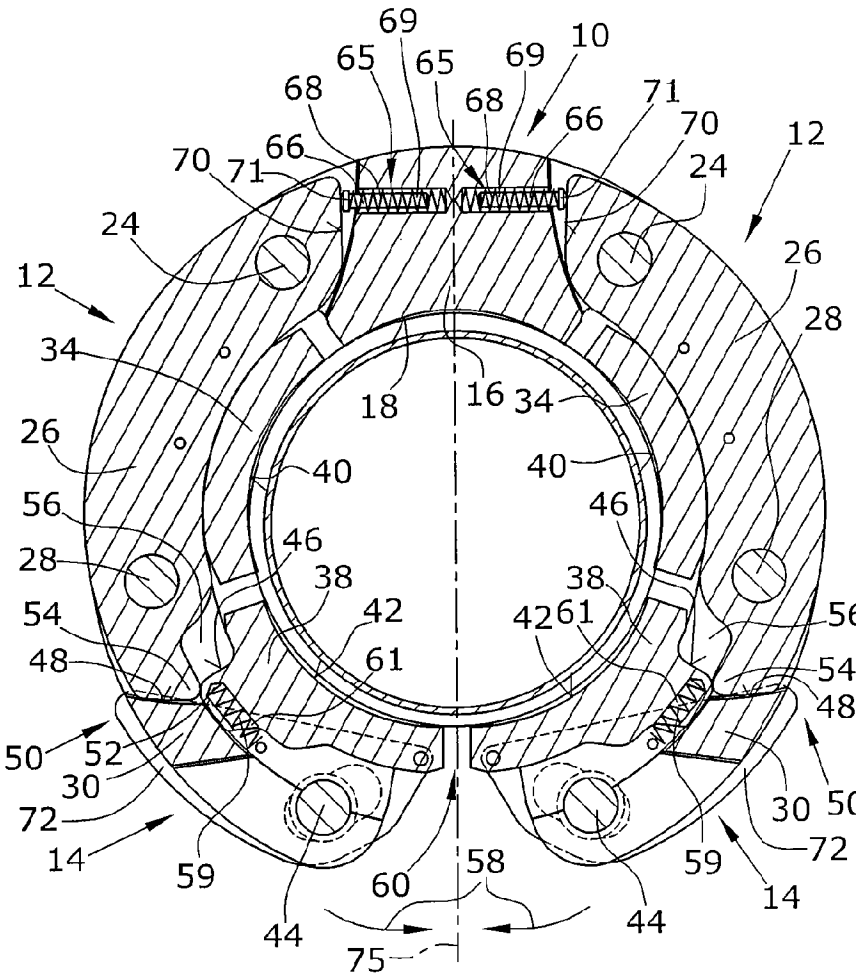

While the press tool is being placed around the to-be-pressed workpieces, i.e. during transfer of the press tool from the position shown in FIG. 3 to the position shown in FIG. 4, there will occur a pivoting movement of the two intermediate press elements 12 about the pins 24 and a pivoting movement of the two end press elements 14 about the pins 28 towards the interior. During the pivoting movement of the two end press elements 14 about the pins 28, a respective abutment face 46 of the press jaws 38 will slide along a guide face 48 which in the illustrated embodiment is formed on the press jaw carriers of the press elements 12. Said abutment element 46 as well as said guide face 48 form substantial portions of guide element 50. By the shape of a cam 52 on press jaws 38 which forms said abutment face 46, and by the shape and position of the cam 54 of press jaw carrier 46 which forms said guide face 48, it is safeguarded that the two press jaws 38 during the first pressing stage will be held in the position shown in FIG. 4.

During transfer of the press tool from the position shown in FIG. 3 to the position shown in FIG. 4, there further occurs a pivoting movement of the two lever elements 72 into the position shown in FIG. 4, i.e. outwardly, since the two press jaws 38 are moving toward each other and there is thus caused a displacement of the pins and resp. bearings 74 relative to the pivot and resp. counterabutment 76.

In this position, the press jaws 38 cannot yet slide, in regard to the adjacent press jaw carriers 26, in the direction of the latter, i.e. particularly not into recesses 56. This is the case substantially because the two cams 52, 54 still partially overlap each other in the radial direction. During a further closing movement of the press tool in the direction of arrows 58, the position of the press jaws 38 relative to the corresponding press jaw carriers will not change during the first pressing phase.

Figure 5:
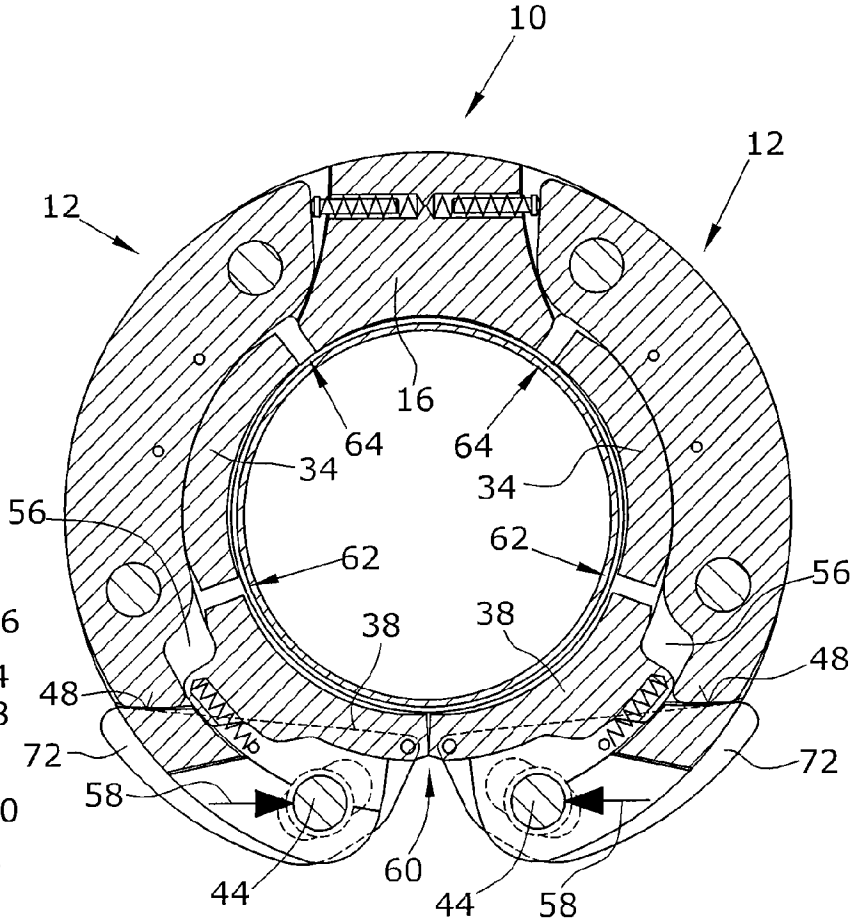

Thus, the movement in the direction of arrows 58 will result in the closing of the closing site 60 between the two press jaws 38 into the position shown in FIG. 5. In this position, the closing site 60 between the two press jaws 38 is at least partially closed. During the first pressing stage, i.e. during transfer of the press tool from the position shown in FIG. 4 into the position shown in FIG. 5, a first pressing action is exerted on the press fitting. Thus, according to a preferred embodiment, the guide faces 48 are inclined in the direction of a closing site or gap 60. During the further closing of the press tool, the two lever elements 72 will be pivoted farther outward (FIG. 5).

In order to guarantee, during the first pressing stage, i.e. during the sliding movement of abutment element 46 along guide face 48, a safe adherence of abutment element 46 on guide face 48, a respective press-on element 59 is provided for each end press jaw element 14. In the illustrated embodiment, said press-on element is a pressure spring. The spring is, on the one hand, fastened to press jaw carrier 30 and, on the other hand, extends into a cutout 61 of press jaw 38.

As soon as the closing site 60 is substantially closed, i.e. when the two press jaws 38 contact each other or have only a small distance to each other, the press jaws 38 can be released from the guide faces 48 or also be guided all the way to the end position. The cam 52 of the respective press jaws 38 can thus slide into recess 56. Thereby, in the further pressing process, the gap 62 between the press jaws 38 and the adjacent press jaws 34 will be closed. Also, in the continued pressing process, i.e. during the further movement of the two pins 44 toward each other, the gap 64 between the press jaws 34 and the fixed press jaw 16 will be closed.

In the second pressing stage (FIGS. 5 and 6), the gaps 62 and 64 will be closed. In the process, press jaw 38 will slide into recess 56. After conclusion of the pressing process, the press jaws 16, 34, 38 are in the position depicted in FIG. 5, with cam 52 of press jaw 38 being fully arranged in recess 56 and filling the same. What is illustrated in FIG. 5 is the absolute end position in which all gaps 60, 62, 64 are closed. Depending on the given circumstances, it may happen that the pressing process is concluded somewhat earlier, thus still leaving slight gaps.

For use during the closing of the press tool, i.e. during transfer of the press tool from the position shown in FIG. 3 into the position shown in FIG. 4, a holding element is provided. In the illustrated embodiment, said holding element comprises two pressurizing elements 65 (FIG. 4). Each pressurizing element 65 in this embodiment comprises a pressure spring 67 as well as a guide element 69 which is surrounded by the spirally shaped pressure spring 66 and which in the presently illustrated embodiment is formed as a guide pin. On its end facing toward the adjacent press element 26, the guide pin 69 comprises a respective head 71 which on its bottom is abutted by the spirally shaped spring 66. In the illustrated embodiment, the two pressure elements 65 are respectively arranged in a cylindrical cutout 86.

In the illustrated embodiment, the two pressure elements 65 are arranged in the main press element 10. Since the illustrated press tool comprises five press elements 10, 12, 14, the press tool is configured symmetrically relative to central line 75. Also the two press elements 65 in the main press element 10 are arranged symmetrically relative to line 75.

The two springs 66 press the respective guide pin 69 outward onto lateral faces 70 of the two press jaw carriers 26. This has the consequence that, after the ring has been initially laid around the to-be-pressed workpieces, the ring will remain in the position shown in FIG. 3, thus to avoid unintended opening of the ring. Due to the holding element which will automatically hold the press tool in the closed position, the handling is distinctly facilitated. Particularly, connecting the drive means to the two pins 44 is considerably easier.

Instead of—or additionally to—the provision of the above described pressing elements, there can also be provided an arresting means. This can be e.g. a locking connection between the adjacent press elements 10-12 and 12-14. As soon as the press tool is fully closed, the locking elements will engage. Afterwards, when the press tool is being opened, the locking elements can be released again in a simple manner by pivoting the lever elements 72.

Figures 6, 7:
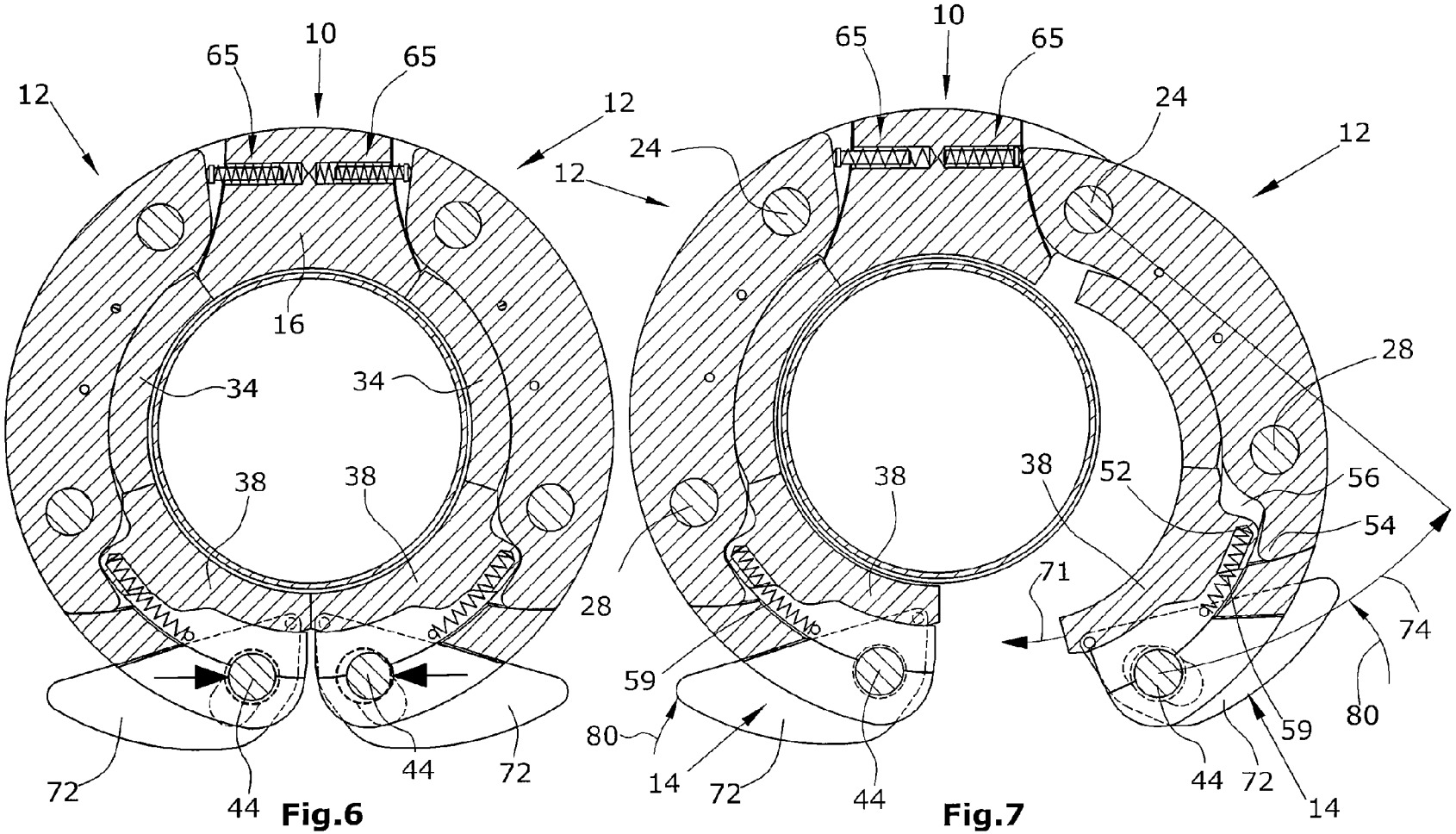

After the press-connecting process, the ring will normally have to be opened again by hand (FIG. 7). This is performed by first removing the drive means from the pins 44. In the next step, it is possible to pivot the two press elements 12 outward about pin 24, as is depicted in FIG. 7 by way of the right-hand press element 12. However, pivoting the two press elements 12 outward is not sufficient to make it possible to pull the press tool in FIG. 7 upward off from the workpiece because, for this to be done, the opening generated between the two press jaws 38 is not sufficient. Thus, it is additionally required to pivot the end press elements 14 outward about the respective pin 28. In the position shown in FIG. 7, however, this is not possible because the cams 52 of the press jaws 38 are still located in recess 56 and thus are in abutment on cam 54. As a consequence, the press jaws 38 have to be displaced in the direction of arrow 71 against the spring force 59. This will be performed by the lever elements 72 provided according to the disclosure. These lever elements will be pressed inward in the direction of arrow 80. Thereby, due to the pivoting of the levers 72 about pin 44, the press jaws 38 will be displaced in the direction of arrow 71. By this displacement of the right-hand press jaw 38 in FIG. 7 to the left in the direction of arrow 71, cam 54 will release cam 52 again, and it is possible to pivot the corresponding end press element 14 outward in the direction of arrow 74. In a corresponding manner, the left-hand press element 12 in FIG. 7 as well as the left-hand end press element 14 will be pivoted outward and resp. in FIG. 7 to the left about the pins 24 and resp. 28. In the process, the press jaw 38 of the left-hand end press element in FIG. 7 has to be displaced inward again, against the force of the springs 59, by pivoting the lever 72 inward in the direction of arrow 80.

What is claimed is:

1. A press tool for connecting tubular workpieces, comprising:

a plurality of articulated press elements connected to one another in the form of a chain, said press tool being open for forming a closing site between two end press elements, at least one of the two end press elements comprising a press jaw carrier with a press jaw arranged for displacement thereon, and a handling element for unlatching the press tool from a closed position in which the closing site is substantially closed, and/or for releasing at least one end press element, the handling element displaces the press jaw and thus releases the same from the closed position.

2. The press tool according to claim 1, wherein the handling element comprises at least one lever element which is pivotally connected to a displaceable press jaw or to the corresponding press jaw carrier and, via an abutment, is connected to the press jaw carrier and to the displaceable press jaw, respectively.

3. The press tool according to claim 1, wherein one lever element is provided for each end press element.

4. The press tool according to claim 2, wherein the abutment comprises a pin guided in a longitudinal hole.

5. The press tool according to claim 4, wherein said pin is arranged on the press jaw carrier or on the lever element, and that the longitudinal hole is arranged in the lever element or on the press jaw carrier.

6. The press tool according to claim 1, wherein, by actuation of the handling element the press jaw is displaced.

7. The press tool according to claim 1, wherein one of the press jaws of the two end press elements cooperates with a guide element, said guide element comprising a recess into which said press jaw extends in the closed position.

8. The press tool according to claim 7, wherein, by pivoting the lever element, the press jaw is displaced relative to the recess.

9. The press tool according to claim 8, wherein at least one of the press jaws of the two end press elements cooperates with a guide element in such a manner that, during the pressing process, the two press jaws of the two end press elements are first moved toward each other in a first pressing stage.

10. The press tool according to claim 9, wherein the guide elements comprise a guide surface having an abutment element abutting thereon, said guide surface being inclined in the direction of a gap formed between the two press jaws of the two end press elements.

11. The press tool according to claim 10, wherein the guide surface is formed by the press element adjacent to the end press element.

12. The press tool according to claim 10, wherein the abutment element is formed on the press jaw of the end press element.

13. The press tool according to claim 7, wherein the recess is provided on an adjacent press element.

14. The press tool according to claim 10, wherein the end press element is articulated to an adjacent press element in such a manner that, when the end press element is being pivoted in the closing direction, the abutment element slides on the guide surface.

15. A press tool for connecting tubular workpieces, comprising:

a plurality of articulated press elements connected to one another in the form of a chain, said press tool being open for forming a closing site between two end press elements, and a handling element for unlatching the press tool from a closed position in which the closing site is substantially closed, and/or for releasing at least one end press element, the handling element comprising at least one lever element which is pivotally connected to a displaceable press jaw and, via an abutment, is connected to a press jaw carrier and to the displaceable press jaw, respectively, wherein the abutment comprises a pin guided in a longitudinal hole.

16. The press tool according to claim 15, wherein said pin is arranged on the press jaw carrier or on the lever element, and that the longitudinal hole is arranged in the lever element or on the press jaw carrier.

17. A press tool for connecting tubular workpieces, comprising:

a plurality of articulated press elements connected to one another in the form of a chain, said press tool being open for forming a closing site between two end press elements, and a handling element for unlatching the press tool from a closed position in which the closing site is substantially closed, and/or for releasing at least one end press element, wherein the end press element is articulated to an adjacent press element in such a manner that, when the end press element is being pivoted in a closing direction, an abutment element slides on a guide surface.

* * * * *